US005954281A

United States Patent [19]

Hayles, Jr.

[11] Patent Number: 5,954,281

[45] **Date of Patent: *Sep. 21, 1999**

[54] APPARATUS AND PROCESS FOR PULVERIZING SOLIDS

[76] Inventor: Peter E. Hayles, Jr., 225 Grover Rd., Toms River, N.J. 08753

[ * ] Notice: This patent is subject to a terminal disclaimer.

[21] Appl. No.: 08/816,641

[22] Filed: Mar. 13, 1997

Related U.S. Application Data

[63] Continuation of application No. 08/410,144, Mar. 23, 1995, which is a continuation-in-part of application No. 08/170,056, Dec. 20, 1993, Pat. No. 5,400,977.

[51] Int. Cl.[6] ..... B02C 13/04

[52] U.S. Cl. ..... 241/187; 241/190; 241/188.1

[58] Field of Search ..... 241/26, 284, 46.11, 241/46.17, 138, 146, 154, 155, 161, 162, 163, 187, 188.1, 189.1, 190, 236, 275

[56] References Cited

U.S. PATENT DOCUMENTS

| | | | |
|---|---|---|---|
| 345,408 | 7/1886 | Birge . | |
| 410,247 | 9/1889 | Kimble . | |
| 489,079 | 1/1893 | Kellner . | |
| 1,439,581 | 12/1922 | Sedberry . | |
| 1,457,693 | 6/1923 | Dorn . | |
| 1,472,609 | 10/1923 | Martin . | |
| 2,068,599 | 1/1937 | Ehrsam . | |
| 3,966,126 | 6/1976 | Werner . | |
| 5,400,977 | 3/1995 | Hayles | 241/161 |

*Primary Examiner*—Mark Rosenbaum
*Attorney, Agent, or Firm*—Louis E. Marn

[57] ABSTRACT

There is disclosed a pulverizing apparatus having paired interconnecting cylindrical chambers wherein each chamber is provided with a rotatable shaft having a plurality of disc sets mounted thereon and wherein each disc set is provided with pivotally mounted thrust guides wherein thrust guide mounted on disc sets positioned in initial stages are provided with plate members to facilitate circulation of large particles. To facilitate stage-wise flow of solids/liquid, the chambers are provided with transversely-mounted weirs members.

9 Claims, 1 Drawing Sheet

APPARATUS AND PROCESS FOR PULVERIZING SOLIDS

This is a continuation of application Ser. No. 08/410,144 filed Mar. 23, 1995 which is a continuation-in-part of U.S. application Ser. No. 08/170,056, filed Dec. 20, 1993 now U.S. Pat. No. 5,400,977.

BACKGROUND OF THE INVENTION

1. Field of the Invention

This invention relates to the pulverization of solids, and more particularly to the pulverization of solids in a fluid medium.

2. Brief Description of the Prior Art

The disposal of drill cuttings has been a longstanding problem in the field of well drilling and this problem has recently received attention due to increased concern regarding the environment. Offshore drilling operations, in particular, are problematic because the transport of the cuttings to a landfill or a shore-based processing system is required. One solution to this problem is disclosed in U.S. Pat. Nos. 5,109,933 and 5,129,469. The prior art system for disposing of drill cuttings as described in these patents involves mixing the cuttings with a carrier liquid, such as water, and reducing the size of the cuttings in a pump having an impeller of a backward swept blade type to form a slurry of the particles and the carrier liquid for injection into a well for disposal.

Particle size reduction is also used in mining processes, preparation of limestone, etc. Pulverizers and material breaking machinery are described, for example, in the following U.S. Pats.: No. 310,940 to Gould; No. 315,064 to Pratt; No. 345,408 to Birge; No. 359,630 to Pratt; No. 666,404 to Wurster; No. 2,049,920 to McNitt; No. 3,927,840 to Nash; No. 3,931,936 to Petry et al.; and No. 4,947,906 to Schroeder.

In copending application Ser. No. 08/170,056, herein incorporated by references, there is described an apparatus for pulverizing drill cuttings from a well bore comprised of a pair of interconnected cylindrical chambers wherein each chamber is provided with a rotatable shaft having a plurality of disc sets mounted thereon wherein the shafts are aligned in parallel relation and operate in a counter rotating manner and wherein each disc set includes at least one pivotally mounted thrust guide in the form of a bar-shaped member. With particulate solids of a size greater than about 50 mesh, power requirements were excessive on initial pulverizing stages. Additionally, there is excessive fluid leakage about the shafts extending through the chambers.

OBJECTS OF THE INVENTION

An object of the present invention is to provide an improved apparatus and process for pulverizing solids of incipient large size to reduced size.

Another object of the present invention is to provide an improved apparatus and process for pulverizing solids and improved sealing capabilities about the rotating shafts.

Yet another object of the present invention is to provide an improved apparatus and process of improved suspension.

Still another object of the present invention is to provide an improved apparatus and process having more efficient thrust guides mounted on disc sets.

SUMMARY OF THE INVENTION

These and other objects of the present invention are achieved in a pulverizing apparatus having paired interconnecting cylindrical chambers wherein each chamber is provided with a rotatable shaft having a plurality of disc sets mounted thereon and wherein each disc set is provided with pivotally mounted thrust guides wherein thrust guide mounted on disc sets positioned in initial stages are provided with plate members to facilitate circulation of large particles. To facilitate stage-wise flow of solids/liquid, the chambers are provided with transversely-mounted weir members.

BRIEF DESCRIPTION OF THE DRAWINGS

Further objects and advantages of the present invention will become apparent upon consideration of the detailed disclosure thereof, especially when taken with the accompanying drawings wherein:

FIG. 4 is an exploded isometric view of a disc set illustrating diverse thrust bars.

DETAILED DESCRIPTION OF THE INVENTION

Figure 1:
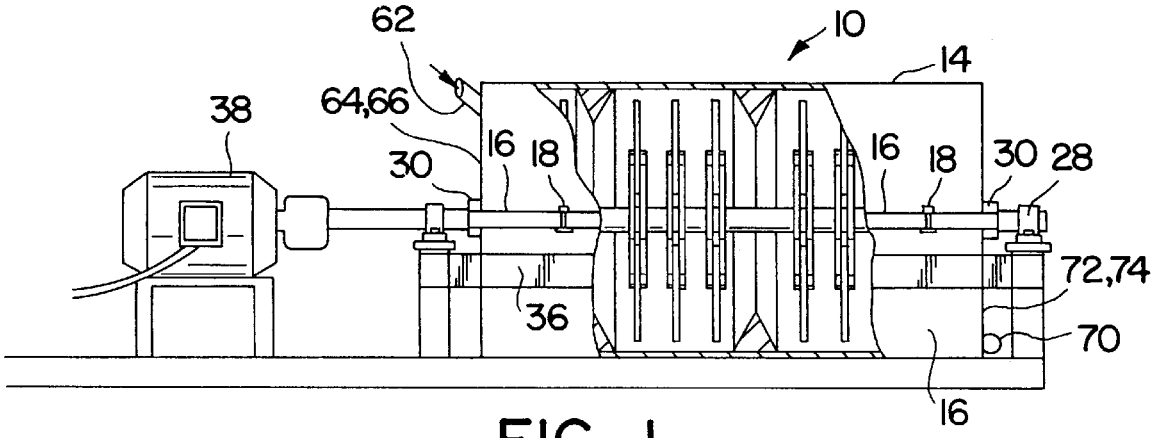
FIG. 1 is an elevational view, partially in section, of the pulverizing assembly of the present invention.
Figure 2:
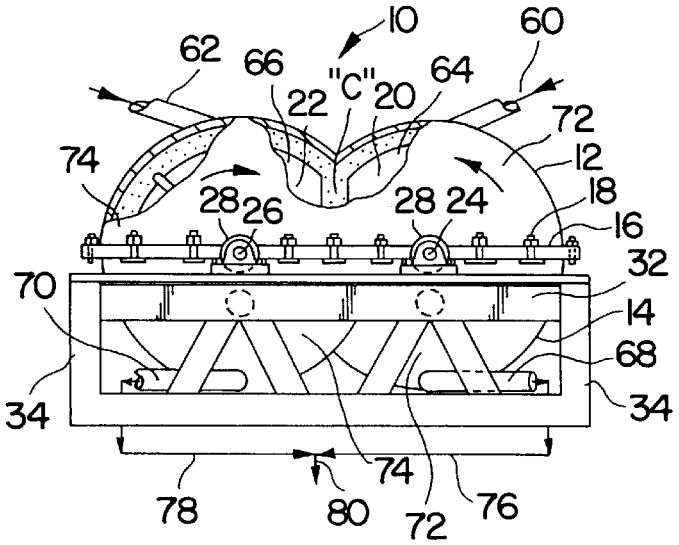
FIG. 2 is an end view, partially in section, thereof.
Figure 3:
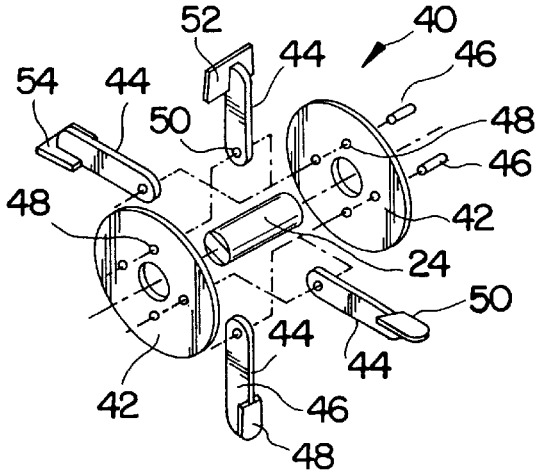
FIG. 3 is a partial cross-sectional top view of the pulverizing assembly of the present invention taken along the lines 3—3 of FIG. 2.

Referring now to the drawings, and in particular FIGS. 1, 2 and 3, there is illustrated a pulverizer, generally indicated as 10, formed by upper and lower tank portions 12 and 14 mounted together peripherally by clamp member 16 held together by bolt/nut assemblies 18. The tank portions 12 and 14 generally form a figure-eight in horizontal cross-section defining respective tank chambers 20 and 22 in fluid communication with each other, as shown in FIG. 2. In each tank chamber 20, 22, there is provided a shaft 24, 26 mounted on support bearing assemblies 28 and extending through bearing member 30 in parallel relation throughout the length of the tank chambers 20, 22. The support bearing assemblies 28 are mounted on horizontal support member 32 mounted to vertical support members 34 disposed on a foundation F. Intermediate horizontal support members 36 are mounted to the vertical support members 34.

Each shaft 24, 26 is rotatably mounted to a respective motor assembly 38 controlled through a separate control breaker panel (not shown). The shafts 24, 26 are freely rotatable in either direction during operation of the pulverizer assembly 10; however, the shafts 24, 26 are preferably rotated in opposite or counter-rotating direction with respect to each other (such as illustrated by the arrows in FIG. 2), as more fully hereinafter described.

A plurality of disc sets, generally indicated as 40 (see FIG. 4), are mounted at spaced intervals along the length of each shaft 24, 26, as illustrated in FIGS. 1 and 3 (as described in the copending application). Each disc set 40 includes a pair of discs 42 welded or otherwise secured to a respective shaft 24, 26, with one or more thrust guides 44 pivotally mounted between each pair of discs 42 by pins or bolts 46 passing through orifice 47 and 50 in the discs 42 and thrust guides 44.

The thrust guides 44 are in the form of elongated bars 46 having impeller plates 48, 50, 52 and 54 perpendicularly-mounted to outer portions thereof, it being understood that generally, like form of impeller plates are mounted to thrust guides 44 of a disc member 40 for an application of the pulverizer assembly 10. As shown in FIG. 4, four thrust guides 44 are pivotally mounted at equal intervals about the circumference of a disc set 40. The length of thrust guides 44 is a function of the radius of each chamber 20, 22. Generally, the thrust guides are dimensioned to provide a spacing of from 1 to 5 inches preferably about 2–3 inches between ends thereof to the inner surface of the chamber 20, 22.

The shape of the impeller plates 48, 50, 52 and 54 are sized as a function of intended duty, and in particular the size and type of solids being processed with consideration to desired particle size of the end product. Impeller plate 50 is angularly positioned on an elongated bar 46 and in an assembly of like such impeller plates 50 mounted to all thrust bars 46 in operation facilitates forward material flow through the pulverizer assembly 10.

Referring again to FIGS. 1, 2 and 3, inlet conduits 60, 62 are tangentially mounted to front end walls 64, 66 of upper tank portion proximate the upper center portion of each chamber 20,22. Outlet conduits 68, 70 are tangentially mounted to rear end walls 72, 74 proximate a lower center portion of each chamber 20, 22. The outlet conduit 68, 70 are connected by lines 76, 78 to product outlet conduit 80.

As disclosed in copending application Ser. No. 08/170,056, the thrust guides 44 are arranged on the disc sets 40 to create a spiral or vortex pattern, proceeding from the inlet conduits 60, 62 to the outlet conduits 68, 70 of the chamber 20, 22. Thus, the thrust guides 44 in each successive disc set 40 are offset by a preselected angle in a clockwise direction. Such offset angle ranges from about 5 degrees to 30 degrees. The spiral or vortex pattern assists in obtaining effectiveness of the thrust guides 44 in circulating and pulverizing the solids with slurry of solid materials. The disc sets 40 are arranged in alternating pattern on the shafts 24 and 26 from feed end to the outlet end, as shown in FIG. 3, so that the first disc set 40 closest to the feed end is on shaft 26 while the next closest disc set 40 to the feed end is on the shaft 28, and so on in alternating relationship back and forth from shaft to shaft. Thus, the disc sets 40 are spaced apart on each shaft defining a space therebetween, and consequently resulting in an overlap between the thrust guide member 44 of the disc set 40 carried by the two shafts 26 and 28 producing an alternating, overlapping pattern of interdigitating configuration. In other words, the thrust guide members 44 mounted on disc sets 40 on shaft 24 extend into and between the space between the thrust members 44 mounted on disc sets 40 on the shaft 26, and vice versa.

As shown in FIGS. 1 and 3, triangularly-shaped weir members 90 are mounted transversely about the inner surface of the chamber 20, 22. Such triangularly-shaped surface of the weir members 90 reduces potential build-up of caked solids about an upstream portion thereof.

Cleanout holes (not shown) are located at the bottom of the chamber 20, 22 to assist in draining the pulverizer assembly 10 when not in use as described in the copending application Ser. No. 08/170,056.

In operation, particulate material, such as oil drill cuttings in slurry form from a well bore is introduced via conduit 60,62 into the pulverizer assembly 10. Generally, such drill cuttings contain particles of a size larger than about 50 mesh. The motor of the motor assemblies 38 are preferably caused to rotate the shafts 24, 26 in counter-rotational directions (see arrow of FIG. 2) with the shafts being rotated at a speed sufficient to cause the slurry to circumferentially flow about the inner surface of each chamber 20, 22 and thereby cause respective slurry flow to contact each other at "C" whereby the particles contained in the drill cuttings are broken up or particulated by continual collisions therebetween proximate the upper meeting point "C" of chambers 20, 22. Particle/particle contact results in concomitant size reduction. The thrust guides 44 of a disc set 40 carried by shaft 24 are preferably positioned to interengage with thrust guides 44 of disc set 40 on the shaft 26 in an overlapping, interdigitating manner.

The action of the thrust guides 44 spins the slurry and forces the solid particles thereof to collide with one another and thereby break up into smaller pieces. Such process continues until the slurry reaches the end walls 72 and 74 and is discharged through outlet conduits 68, 70 for reinjection into the well bore.

The inlet conduits 60 and 62 are tangentially mounted and thus positioned to facilitate entry of the feed into the rotating slurry circumferential flow about the inner wall of the chamber 20, 22. The outlet conduits are tangentially mounted to facilitate product outlet flow also in concurrent flow of the rotating slurry.

While the invention has been described in connection with the exemplary embodiment thereof, it will be understood that many modifications will be apparent to those of ordinary skill in the art and that this application is intended to cover any adaptations or variations thereof. Therefore, it is manifestly intended that this invention be only limited by the claims and the equivalents thereof.

What is claimed is:

1. A pulverizing assembly, which comprises:

a tank member having interconnecting cylindrically-shaped chambers defining inner surfaces thereof;

a shaft rotatably disposed in each of said chambers, said shafts being parallelly-disposed to one another;

a plurality of disc members mounted on each of said shafts generally transverse to a longitudinal axis of each chamber, disc members mounted on one parallelly-disposed shaft being in interdigitating relationship to disc member mounted on another parallelly-disposed shaft;

at least one thrust guide member mounted on each of said disc members, thrust guide members pivotally mounted on disc members mounted on said one shaft extending between thrust guide members mounted on disc members mounted on another parallelly disposed shaft;

inlet conduit means for introducing for size reduction particulate material into said tank member;

outlet conduit means for removing size reduced particulate material from said tank member; and means for rotating said shafts at a speed to cause particulate material to flow about said inner surfaces of said chambers in a manner to cause respective flows to contact each other in particle/particle contact to effect particle size reduction.

2. The pulverizing assembly as defined in claim 1 wherein said thrust guides are provided with impeller members positioned at end portions thereof.

3. The pulverizing assembly as defined in claim 2 wherein said impeller members are flat plates angularly-mounted to said bar member to facilitate forward slurry flow through said pulverizing assembly.

4. The pulverizing assembly as defined in claim 2 wherein said impeller members are angularly positioned to augment forward slurry flow through said chambers.

5. The pulverizing assembly as defined in claim 4 wherein said impeller members are flat plates perpendicularly-mounted to a bar member of a thrust guide.

6. The pulverizing assembly as defined in claim 1 wherein weir members are mounted to said inner surfaces of said chambers.

7. The pulverizing assembly as defined in claim 6 wherein said weirs are triangularly-shaped.

8. The pulverizing assembly as defined in claim 1 wherein said inlet conduit means are inlet conduits tangentially positioned on said tank member for tangential introduction in concurrent flow of said particulate material into a respective chamber of said tank member.

9. The pulverizing assembly as defined in claim 1 wherein said outlet conduit means are outlet conduits tangentially-positioned on said tank member for tangential withdrawal in concurrent flow of said slurry from a respective chamber.

* * * * *